US011603858B2

(12) United States Patent
Oda et al.

(10) Patent No.: US 11,603,858 B2
(45) Date of Patent: Mar. 14, 2023

(54) METHOD FOR MANUFACTURING COMPRESSOR AND COMPRESSOR

(71) Applicant: MITSUBISHI HEAVY INDUSTRIES COMPRESSOR CORPORATION, Tokyo (JP)

(72) Inventors: Takashi Oda, Hiroshima (JP); Daisuke Hirata, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 72 days.

(21) Appl. No.: 17/155,426

(22) Filed: Jan. 22, 2021

(65) Prior Publication Data

US 2021/0246906 A1 Aug. 12, 2021

(30) Foreign Application Priority Data

Feb. 7, 2020 (JP) ..... JP2020-019971

(51) Int. Cl.
*F04D 29/42* (2006.01)
*F04D 29/08* (2006.01)
*F04D 29/62* (2006.01)

(52) U.S. Cl.
CPC ..... *F04D 29/4206* (2013.01); *F04D 29/083* (2013.01); *F04D 29/624* (2013.01)

(58) Field of Classification Search
CPC .... F04D 29/083; F04D 29/4206; F04D 29/60; F04D 29/601; F04D 29/624
See application file for complete search history.

(56) References Cited

U.S. PATENT DOCUMENTS

| | | | | |
|---|---|---|---|---|
| 9,488,188 | B2 * | 11/2016 | Ota | F04D 29/083 |
| 9,556,879 | B2 * | 1/2017 | Shinohara | F04D 17/122 |
| 9,587,644 | B2 * | 3/2017 | Higashio | F04D 17/122 |
| 10,364,820 | B1 * | 7/2019 | Oda | F04D 29/622 |
| 2014/0178183 | A1 * | 6/2014 | Masuda | F04D 29/624 415/173.1 |
| 2018/0320597 | A1 * | 11/2018 | Nass | F02C 7/28 |

FOREIGN PATENT DOCUMENTS

WO 2019-207761 A1 10/2019

* cited by examiner

*Primary Examiner* — Brian P Wolcott
(74) *Attorney, Agent, or Firm* — Osha Bergman Watanabe & Burton LLP

(57) ABSTRACT

A method for manufacturing a compressor includes a step of installing a bundle having an O-ring on an outer peripheral surface inside a lower half casing so that a position of the O-ring in an axial direction coincides with a position of a lower half relief groove, a step of installing an upper half casing having an upper half relief groove on the lower half casing so that a position of the upper half relief groove in the axial direction coincides with the position of the O-ring, and a step of pressing the bundle in the axial direction to move the O-ring to a position away from the lower half relief groove and the upper half relief groove, and bringing the O-ring into contact with the inner peripheral surface of the lower half casing and the inner peripheral surface of the upper half casing.

4 Claims, 9 Drawing Sheets

METHOD FOR MANUFACTURING COMPRESSOR AND COMPRESSOR

BACKGROUND OF THE INVENTION

Field of the Invention

The present disclosure relates to a method for manufacturing a compressor and a compressor.

Priority is claimed on Japanese Patent Application No. 2020-019971, filed on Feb. 7, 2020, the content of which is incorporated herein by reference.

Description of Related Art

A centrifugal compressor causes gases to pass through rotating impellers, and compresses the gases by using a centrifugal force generated at that time. As the centrifugal compressor, a multi-stage centrifugal compressor is known which includes a plurality of the impellers to compress the gases in a stepwise manner.

The centrifugal compressor configured in this way has a structure including a casing that can be divided upward and downward by a dividing surface extending in a horizontal direction. Specifically, the casing is configured as follows. An upper half casing is placed on a lower half casing installed on a floor surface, and both are fastened to each other by a bolt. In the centrifugal compressor, a rotor is disposed to penetrate the casing. The rotor is rotatable with respect to the casing.

For example, International Publication No. WO2019/207761 discloses a configuration including a bundle accommodated inside the casing, a communication gap sealing portion, and a restriction portion. The bundle has the impeller, a plurality of diaphragms, and an annular head provided on both sides in an axial direction with respect to the plurality of diaphragms to close an opening of the casing. The restriction portion restricts a position of the head in the axial direction with respect to the casing. The restriction portion has a fitting recess portion formed on one of an outer peripheral surface of the head and an inner peripheral surface of the casing, and a fitting projection portion fitted to the fitting recess portion by being formed on the other of the outer peripheral surface of the head and the inner peripheral surface of the casing.

In a case of this configuration, a gap is formed between the inner peripheral surface of the casing and the outer peripheral surface of the diaphragm. Therefore, a suction port and a discharge port communicate with each other via the gap. As a result, due to a pressure difference between the discharge port and the suction port, a fluid flows into the gap from the discharge port toward the suction port, thereby causing a possibility that the fluid may leak.

In contrast, the configuration disclosed in International Publication No. WO2019/207761 includes the communication gap sealing portion that seals a communication gap between the outer peripheral surface of the diaphragm and the inner peripheral surface of the casing. Therefore, the configuration reduces the possibility that the fluid may flow from the discharge port toward the suction port.

SUMMARY OF THE INVENTION

However, according to the configuration disclosed in International Publication No. WO2019/207761 as described above, when a sealing portion such as the communication gap sealing portion is an O-ring, it is necessary to prevent damage to the O-ring when assembled in order to ensure sealing performance. Specifically, when the bundle is incorporated in the lower half casing and when the upper half casing is incorporated on the bundle incorporated in the lower half casing so that the O-ring does not rub against the lower half casing or the upper half casing, it is necessary to accurately align all of these in the axial direction. The bundle or the upper half casing is a large and heavy object, and thus, it takes a lot of time and effort to accurately align the bundle or the upper half casing in the axial direction. Therefore, it takes time to assemble the compressor.

The present disclosure provides a method for manufacturing a compressor and a compressor which are capable of efficiently assembling the compressor while preventing damage to an O-ring.

According to the present disclosure, a method is provided for manufacturing a compressor, which includes a step of preparing a casing that includes a lower half casing having a lower half relief groove recessed from an inner peripheral surface and extending in a circumferential direction and an upper half casing having an upper half relief groove recessed from an inner peripheral surface and extending in the circumferential direction, and has a cylindrical shape having an open end portion and formed around an axis, a step of preparing a bundle that has a columnar shape, includes an impeller and a plurality of diaphragms, configured to be disposed inside the casing, and includes an O-ring disposed on an outer peripheral surface, a step of installing the lower half casing, a step of installing the bundle inside the lower half casing from above the lower half casing so that a position of the O-ring in an axial direction in which the axis extends coincides with a position of the lower half relief groove in the axial direction, a step of installing the upper half casing on the lower half casing from above the bundle so that a position of the upper half relief groove in the axial direction coincides with the position of the O-ring in the axial direction, and a step of pressing the bundle from a first side to a second side in the axial direction to move the O-ring to a position away from the lower half relief groove and the upper half relief groove, and bringing the O-ring into contact with the inner peripheral surface of the lower half casing and the inner peripheral surface of the upper half casing.

According to the present disclosure, a compressor is provided including a casing that includes a lower half casing having a lower half relief groove recessed from an inner peripheral surface and extending in a circumferential direction and an upper half casing having an upper half relief groove recessed from an inner peripheral surface and extending in the circumferential direction, and has a cylindrical shape having an open end portion and formed around an axis, and a bundle disposed inside the casing, that has a columnar shape, that includes an impeller and a plurality of diaphragms, and that includes an O-ring disposed on an outer peripheral surface. The O-ring is in contact with the inner peripheral surface of the lower half casing and the inner peripheral surface of the upper half casing. The lower half relief groove and the upper half relief groove are formed at positions shifted to a first side in an axial direction in which the axis extends with respect to the O-ring.

According to the method for manufacturing a compressor and the compressor of the present disclosure, it is possible to efficiently assemble the compressor while preventing damage to the O-ring.

DETAILED DESCRIPTION OF THE INVENTION

Hereinafter, an embodiment of a compressor of the present invention will be described with reference to the drawings.

(Configuration of Compressor)

Figure 1:
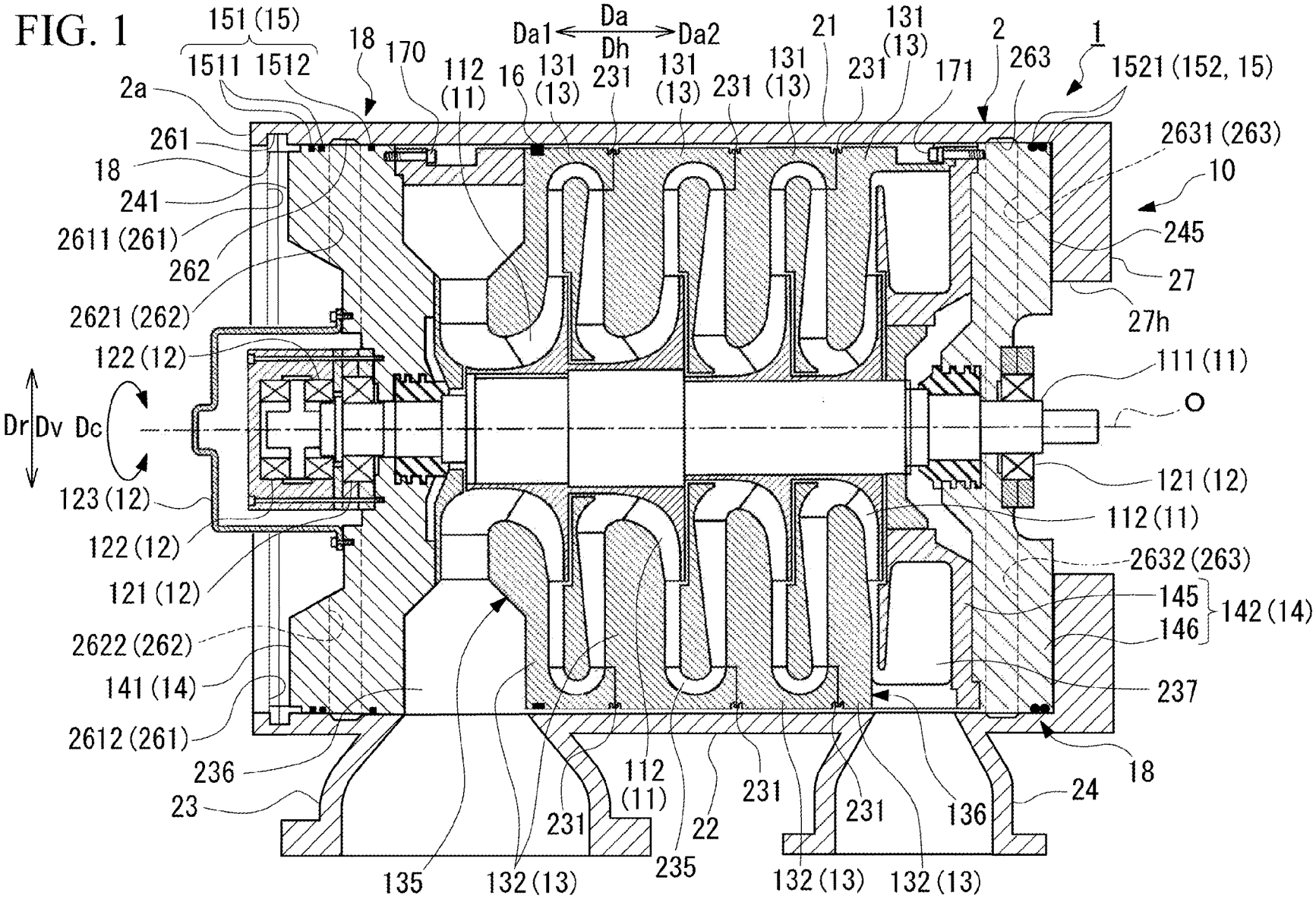
FIG. 1 is a sectional view illustrating a configuration of a compressor according to the present embodiment.
Figure 2:
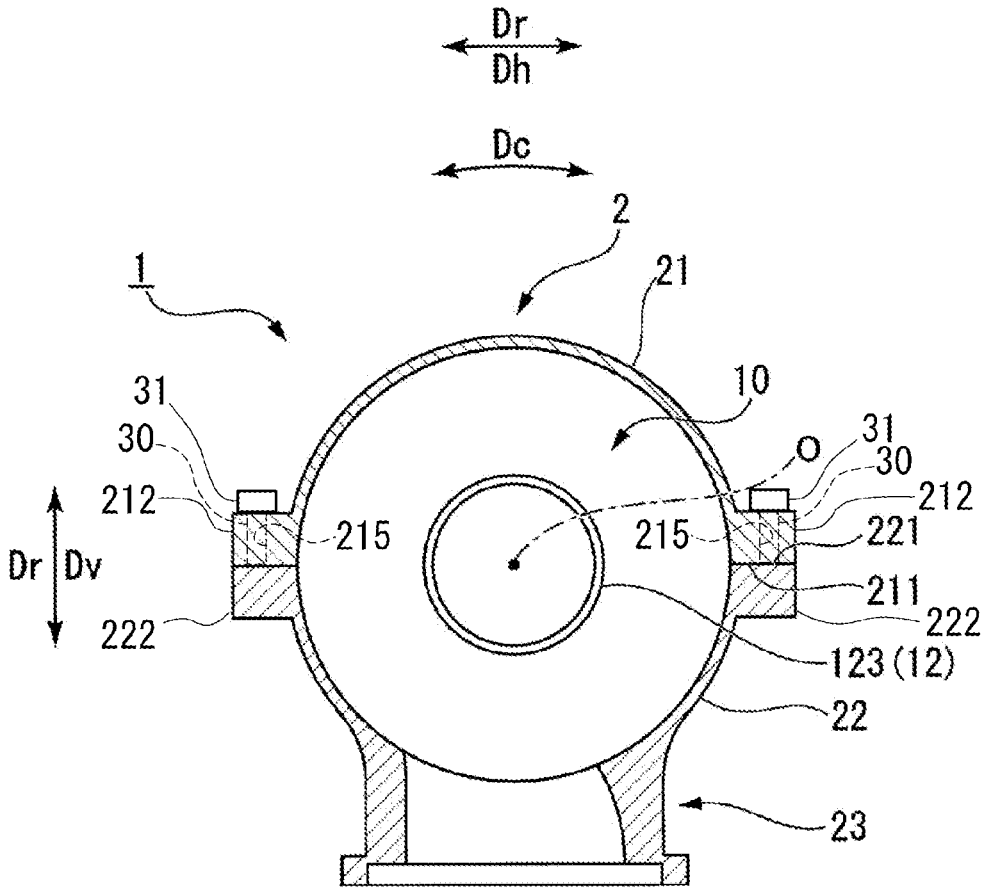
FIG. 2 is a sectional view when the compressor is viewed in an axial direction.

As illustrated in FIG. 1, a compressor 1 of the present embodiment is a uniaxial multi-stage centrifugal compressor (multi-stage centrifugal compressor) including a plurality of impellers 112. As illustrated in FIGS. 1 and 2, the compressor 1 of the present embodiment includes a casing 2, a bundle 10, and a restriction member 18.

Hereinafter, a direction in which an axis O of a rotor 11 (to be described later) extends will be referred to as an axial direction Da. A radial direction with reference to the axis O will be simply referred to as a radial direction Dr. In the radial directions Dr perpendicular to the axis O, an upward-downward direction on a paper surface in FIGS. 1 and 2 will be referred to as a vertical direction Dv. In addition, a rightward-leftward direction in FIGS. 1 and 2, which is the radial direction Dr and the axial direction Da perpendicular to the axis O, will be referred to as a horizontal direction Dh. In addition, a direction in which the rotor 11 turns around the axis O will be referred to as a circumferential direction Dc.

(Configuration of Casing)

The casing 2 is disposed to cover the bundle 10 from an outer peripheral side. The casing 2 has a cylindrical shape formed around a central axis disposed coaxially with the axis O of the rotor 11 (to be described later). One side Da1 (first side) of the casing 2 in the axial direction Da is open to have a size into which the bundle 10 can be inserted. An end plate 27 is formed on the other side Da2 (second side) of the casing 2 in the axial direction Da. The end plate 27 has a plate shape extending to be orthogonal to the axial direction Da. An insertion hole 27*h* having a size into which the rotor 11 can be inserted and the bundle 10 cannot be inserted is formed in a central portion of the end plate 27. The cylindrical casing 2 has an upper half casing 21 located above in the vertical direction Dv and a lower half casing 22 located below in the vertical direction Dv (refer to FIG. 2).

In the upper half casing 21, a cross section orthogonal to the axis O has a semicircular ring shape formed around the axis O, and extends in the axial direction Da. The upper half casing 21 is open downward in the vertical direction Dv so that the bundle 10 is fitted thereto. In this manner, the upper half casing 21 covers an outer peripheral surface of the bundle 10 accommodated therein from above. As illustrated in FIG. 2, the upper half casing 21 of the present embodiment has flanges 212 extending in the horizontal direction Dh at both ends in the circumferential direction Dc. The upper half casing 21 has upper half casing dividing surfaces 211 at both ends in the circumferential direction Dc. The upper half casing dividing surface 211 is one dividing surface when the casing 2 is divided upward and downward in the vertical direction Dv. The upper half casing dividing surface 211 is a plane extending in the radial direction Dr and the axial direction Da. That is, the upper half casing dividing surface 211 is a horizontal plane facing downward in the vertical direction Dv.

In the lower half casing 22, a cross section orthogonal to the axis O has a semicircular ring shape formed around the axis O and extends in the axial direction Da. The lower half casing 22 is open upward in the vertical direction Dv so that the bundle 10 is fitted thereto. In this manner, the lower half casing 22 covers the outer peripheral surface of the bundle 10 accommodated therein from below. The lower half casing 22 of the present embodiment has flanges 222 extending in the horizontal direction Dh at both ends in the circumferential direction Dc. The lower half casing 22 has lower half casing dividing surfaces 221 at both ends in the circumferential direction Dc. The lower half casing dividing surface 221 is the other dividing surface when the casing 2 is divided upward and downward in the vertical direction Dv. The lower half casing dividing surface 221 is a plane extending in the radial direction Dr and the axial direction Da. That is, the lower half casing dividing surface 221 is a horizontal plane facing upward in the vertical direction Dv. In addition, as illustrated in FIG. 1, the lower half casing 22 has a suction port 23 that supplies a process gas (fluid) to be compressed into the casing 2 and a discharge port 24 that discharges the compressed process gas from the inside of the casing 2.

As illustrated in FIG. 2, a plurality of turbine casing bolts (guide rod attachment portions) 30 are fixed to each of the lower half casing dividing surfaces 221 of the lower half casing 22. The plurality of turbine casing bolts 30 are disposed at a predetermined interval in the axial direction Da. Each of the turbine casing bolts 30 protrudes upward in the vertical direction Dv from the lower half casing dividing surface 221.

A plurality of positioning holes 215 are formed in the flanges 212 at both ends of the upper half casing 21 in the circumferential direction Dc. The positioning hole 215 is formed through the flange 212 to be open on the upper half casing dividing surface 211. The plurality of turbine casing bolts 30 attached to the lower half casing 22 are inserted into the plurality of positioning holes 215. A nut 31 can be screwed to a tip of the turbine casing bolt 30 inserted into the positioning hole 215 from above the flange 212 in the vertical direction Dv. The nut 31 is fixed to the tip of the turbine casing bolt 30, thereby connecting the flange 212 of the upper half casing 21 and the flange 222 of the lower half casing 22 to each other.

(Configuration of Bundle)

As illustrated in FIG. 1, the bundle 10 is accommodated inside the casing 2. The bundle 10 of the present embodiment has a rotor 11, a bearing portion 12, a plurality of diaphragms 13, a plurality of heads 14, a sealing portion 15, and a communication gap sealing portion 16. In the bundle 10, the rotor 11, the bearing portion 12, the plurality of diaphragms 13, the plurality of heads 14, the sealing portion 15, and the communication gap sealing portion 16 are in an integrally movable state.

(Configuration of Rotor)

The rotor 11 is rotatable around the axis O. The rotor 11 has a rotor shaft 111 extending in the axial direction Da around the axis O, and a plurality of impellers 112 rotating together with the rotor shaft 111.

The impeller 112 is fixed to an outer peripheral surface of the rotor shaft 111. The impeller 112 rotates together with the rotor shaft 111 so that the process gas is compressed by using a centrifugal force. The impellers 112 are provided in a plurality of stages in the axial direction Da with respect to the rotor shaft 111. The impeller 112 is a so-called open type impeller including a disc and a blade.

(Configuration of Bearing Portion)

The bearing portion 12 supports the rotor shaft 111 to be rotatable around the axis O. The bearing portion 12 is fixed to a head 14 (to be described later). The bearing portion 12 has a pair of journal bearings 121 respectively provided at both ends of the rotor shaft 111, and a thrust bearing 122 provided in one end of the rotor shaft 111.

The pair of journal bearings 121 has a role of receiving a load acting on the rotor shaft 111 in the radial direction Dr. The journal bearings 121 are respectively fixed to the pair of heads 14 by using attachable and detachable fixing means (not illustrated) such as a bolt.

The thrust bearing 122 has a role of receiving a load acting on the rotor shaft 111 in the axial direction Da. The thrust bearing 122 is attached to the inside of a box-shaped bearing cover 123. The bearing cover 123 is fixed to one of the heads 14 by using attachable and detachable fixing means such as a bolt.

(Configuration of Diaphragm)

The diaphragm 13 is disposed to cover the rotor 11 from the outer peripheral side. The diaphragm 13 has an annular shape around the axis O. The annular diaphragm 13 has an upper half diaphragm 131 having a semicircular ring shape formed upward in the vertical direction Dv with reference to the axis O of the rotor 11, and a lower half diaphragm 132 having a semicircular ring shape formed downward. The upper half diaphragm 131 and the lower half diaphragm 132 are fixed by attachable and detachable fixing means such as a bolt. A plurality (four in this embodiment) of the diaphragms 13 are aligned to be stacked in the axial direction Da. The plurality of diaphragms 13 have a cylindrical shape extending in the axial direction Da. The plurality of diaphragms 13 are fixed to each other, thereby internally defining a flow path to be introduced into a flow path of the impeller 112.

Specifically, the outer peripheral surfaces of the adjacent diaphragms 13 are fixed to each other by means of welding. A welding portion 231 is formed on the outer peripheral surface of the adjacent diaphragms 13. The plurality of diaphragms 13 are fixed to and integrated with each other by the welding portion 231.

(Configuration of Flow Path)

Here, specifically, a flow path formed by the diaphragm 13 will be described in the order from an upstream side which is one side Da1 (first side) in the axial direction Da. In the present embodiment, the diaphragm 13 defines a suction port 236, a plurality of casing flow paths 235, and a discharge port 237 together with the casing 2 and the head 14 (to be described later) in the order from the upstream side where the process gas flows.

The suction port 236 causes the process gas flowing from the outside of the casing 2 via the suction port 23 to flow into the casing flow path 235 inside the diaphragm 13. The suction port 236 causes the process gas to flow into the impeller 112 disposed uppermost stream. The suction port 236 has an inlet guide vane.

The casing flow path 235 is formed inside the diaphragm 13. The casing flow path 235 supplies the process gas from the suction port 236 to the impeller 112 disposed uppermost stream, supplies the process gas discharged from the impeller 112 disposed upstream to the impeller 112 disposed downstream, or supplies the process gas discharged from the impeller 112 disposed lowermost stream to the discharge port 237.

The discharge port 237 discharges the process gas flowing inside the diaphragm 13 to the outside of the casing 2 via the discharge port 24. The discharge port 237 discharges the process gas discharged from the impeller 112 disposed lowermost stream to the outside.

(Configuration of Head)

The pair of heads 14 is an annular member, and is formed to have a size capable of closing both end openings of the casing 2. Both end portions of the rotor shaft 111 are respectively inserted into the heads 14. The head 14 of the present embodiment has a suction side head 141 disposed on one side Da1 (first side) in the axial direction Da with respect to the plurality of diaphragms 13 and a discharge side head 142 disposed on the other side Da2 (second side) in the axial direction Da with respect to the plurality of diaphragms 13.

The suction side head 141 is disposed at a position closer to the suction port 236 than the discharge side head 142. The suction side head 141 forms a suction port 236 together with an inlet wall 135 which is the diaphragm 13 disposed closest to one side Da1 in the axial direction Da. A suction side head exterior surface 241 which is a surface facing one side Da1 in the axial direction Da of the suction side head 141 faces the outside of the compressor 1. The suction side head 141 is fixed by using the plurality of integrated diaphragms 13 and a bolt member 170. Specifically, the bolt member 170 is disposed via a groove recessed from the outer peripheral surface of the inlet wall 135. The inlet wall 135 and the suction side head 141 are respectively fixed to the upper half diaphragm 131 and the lower half diaphragm 132 by the bolt members 170 at every two locations. The number of respective locations fixed by the bolt members 170 is not limited to two, and may be three or more. In this manner, the suction side head 141 is integrated with the diaphragm 13.

The discharge side head 142 is disposed at a position closer to the discharge port 237 than the suction side head 141. The discharge side head 142 forms a discharge port 237 together with a final stage diaphragm 136 which is a diaphragm 13 disposed closest to the other side Da2 in the axial direction Da. The discharge side head 142 of the present embodiment has an outlet wall portion 145 forming a portion of the discharge port 237 and a discharge side head body 146 fixed to the outlet wall portion 145.

The discharge side head body 146 is adjacent to the other side Da2 of the outlet wall portion 145 in the axial direction Da. The discharge side head surface 245 which is a surface facing the other side Da2 in the axial direction Da of the discharge side head body 146 abuts the end plate 27 in the axial direction Da. The discharge side head 142 is fixed to the plurality of integrated diaphragms 13 by a bolt member 171. Specifically, the bolt member 171 is disposed via a groove recessed from the outer peripheral surface of the final stage diaphragm 136. The final stage diaphragm 136 and the discharge side head body 146 are respectively fixed at a plurality of locations in the upper half diaphragm 131 and the lower half diaphragm 132 by the bolt members 171. In this manner, the discharge side head body 146 is integrated with the diaphragm 13.

A distance in the axial direction Da from the suction side head exterior surface 241 to the discharge side head surface 245 is shorter than a length of the casing 2 in the axial direction Da. In the present embodiment, in a state where the bundle 10 is accommodated in the casing 2, the suction side head 141 is disposed on the other side Da2 in the axial direction Da with respect to the end portion 2*a* of one side Da1 in the axial direction Da of the casing 2. In other words, the end portion 2*a* of one side Da1 in the axial direction Da of the casing 2 is formed to protrude to one side Da1 in the axial direction Da from the suction side head 141.

(Configuration of Sealing Portion)

Figure 3:
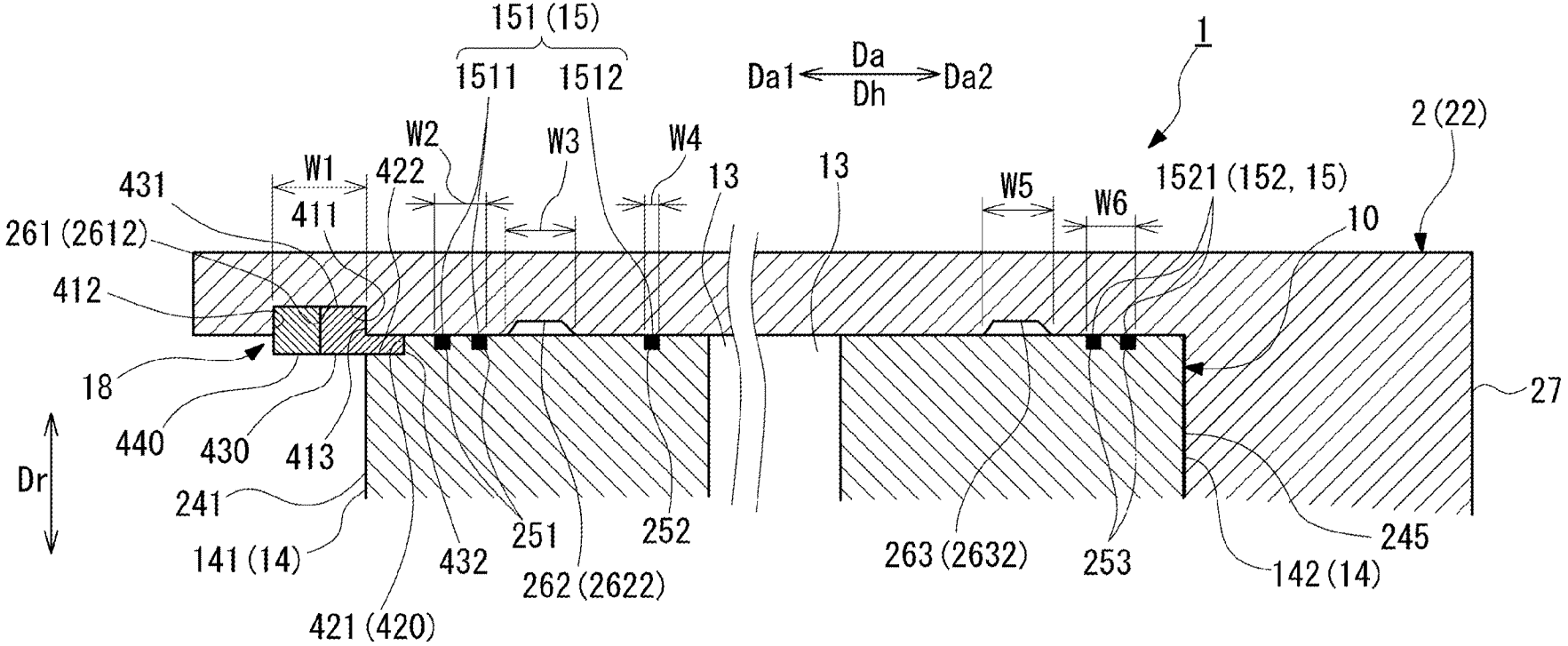
FIG. 3 is a plan sectional view illustrating a positional relationship between an O-ring and a relief groove which are provided in the compressor.

As illustrated in FIGS. 1 and 3, the sealing portion 15 seals a portion between the outer peripheral surface of the head 14 and the inner peripheral surface of the casing 2. The sealing portion 15 has a first sealing portion 151 fixed to the suction side head 141 and a second sealing portion 152 fixed to the discharge side head 142.

(Configuration of First Sealing Portion)

The first sealing portion 151 has an O-ring that seals a portion between the outer peripheral surface of the suction side head 141 and the inner peripheral surface of the casing 2. The first sealing portion 151 has a first O-ring 1511 and a second O-ring 1512 as the O-rings. The first O-ring 1511 has an annular shape and surrounds the entire periphery of the suction side head 141. In the present embodiment, a plurality of (two pairs) of the first O-rings 1511 are disposed at an interval in the axial direction Da. Each of the first O-rings 1511 is accommodated in a first head seal attachment groove 251 formed on the outer peripheral surface of the suction side head 141. Two first head seal attachment grooves 251 are formed to be aligned in the axial direction Da. The first head seal attachment groove 251 is formed at a position closer to one side Da1 (side opposite to a side where the diaphragm 13 is disposed with respect to the head 14) than a center in the axial direction Da, on the outer peripheral surface of the suction side head 141. The first O-ring 1511 accommodated in the first head seal attachment groove 251 protrudes outward in the radial direction from the outer peripheral surface of the suction side head 141 and is in contact with the inner peripheral surface of the casing 2.

The second O-rings 1512 are disposed at an interval from the first O-ring 1511 on the other side Da2 (side where the diaphragm 13 is disposed with respect to the head 14) in the axial direction Da. The second O-ring 1512 has an annular shape, and surrounds the entire periphery of the suction side head 141. In the present embodiment, only one second O-ring 1512 is disposed. The second O-ring 1512 is accommodated in a second head seal attachment groove 252 formed on the outer peripheral surface of the suction side head 141. The second head seal attachment groove 252 is formed at a position closer to the other side Da2 than the center in the axial direction Da, on the outer peripheral surface of the head 14. The second O-ring 1512 accommodated in the second head seal attachment groove 252 protrudes outward in the radial direction Dr from the outer peripheral surface of the suction side head 141 and is in contact with the inner peripheral surface of the casing 2.

(Configuration of Second Sealing Portion)

The second sealing portion 152 has an O-ring that seals a portion between the outer peripheral surface of the discharge side head 142 and the inner peripheral surface of the casing 2. The second sealing portion 152 has a third O-ring 1521 as the O-ring. The third O-ring 1521 has an annular shape and surrounds the entire periphery of the discharge side head 142. In the present embodiment, a plurality of (two pairs) of the third O-rings 1521 are disposed at an interval in the axial direction Da. The third O-ring 1521 is accommodated in a third head seal attachment groove 253 formed on the outer peripheral surface of the discharge side head 142. Two third head seal attachment grooves 253 are formed to be aligned in the axial direction Da. The third head seal attachment groove 253 is formed at a position closer to the other side Da2 than the center in the axial direction Da, on the outer peripheral surface of the discharge side head 142. The third O-ring 1521 accommodated in the third head seal attachment groove 253 protrudes outward in the radial direction Dr from the outer peripheral surface of the discharge side head 142 and is in contact with the inner peripheral surface of the casing 2.

(Configuration of Relief Groove)

The inner peripheral surface of the casing 2 has a relief groove for temporarily avoiding contact with the O-ring of the sealing portion 15 when the casing 2 and the bundle 10 are assembled to each other. The relief groove is recessed from an inner peripheral surface thereof so that the O-ring does not come into contact with the inner peripheral surface of the lower half casing 22 and the upper half casing 21 or a dividing surface (upper half casing dividing surface 211 and lower half casing dividing surface 221), when the bundle 10 is placed on the lower half casing 22 or when the upper half casing 21 is placed on the bundle 10. A first relief groove 261, a second relief groove 262, and a third relief groove 263 are formed as the relief grooves on the inner peripheral surface of the casing 2 of the present embodiment.

The first relief groove 261 is formed on the inner peripheral surface of the casing 2 in order to avoid contact with the first O-ring 1511 when assembled. The first relief groove 261 is formed at a position shifted to one side Da1 in the axial direction Da with respect to the first O-ring 1511 fixed to the bundle 10 in a state where the bundle 10 is fixed to the casing 2. The first relief groove 261 is formed in a portion protruding to one side Da1 in the axial direction Da from the suction side head 141 in the end portion of the casing 2. The first relief groove 261 has a first upper half relief groove (upper half relief groove) 2611 formed in the upper half casing 21 and a first lower half relief groove (lower half relief groove) 2612 formed in the lower half casing 22. The first upper half relief groove 2611 is recessed outward in the radial direction Dr from the inner peripheral surface of the upper half casing 21 and extends in the circumferential direction Dc. The first lower half relief groove 2612 is formed at a position the same as that of the first upper half relief groove 2611 in the axial direction Da. The first lower half relief groove 2612 is recessed outward in the radial direction Dr from the inner peripheral surface of the lower half casing 22 and extends in the circumferential direction Dc. As illustrated in FIG. 3, a width dimension W1 in the axial direction Da of the first relief groove 261 is larger than a width dimension W2 in the axial direction Da where the two pairs of first O-rings 1511 are provided.

The second relief groove 262 is formed on the inner peripheral surface of the casing 2 in order to avoid contact with the second O-ring 1512 when assembled. As illustrated in FIGS. 1 and 3, the second relief groove 262 is formed at a position shifted to one side Da1 in the axial direction Da with respect to the second O-ring 1512 fixed to the bundle 10 in a state where the bundle 10 is fixed to the casing 2. The second relief groove 262 is formed between the first O-ring 1511 and the second O-ring 1512, at a position overlapping the suction side head 141 in the axial direction Da. The second relief groove 262 has a second upper half relief groove (upper half relief groove) 2621 formed in the upper half casing 21 and a second lower half relief groove (lower half relief groove) 2622 formed in the lower half casing 22. The second upper half relief groove 2621 is recessed outward in the radial direction Dr from the inner peripheral surface of the upper half casing 21 and extends in the circumferential direction Dc. The second lower half relief groove 2622 is formed at a position the same as that of the second upper half relief groove 2621 in the axial direction Da. The second lower half relief groove 2622 is recessed outward in the radial direction Dr from the inner peripheral surface of the lower half casing 22 and extends in the circumferential direction Dc. As illustrated in FIG. 3, a width dimension W3 in the axial direction Da of the second relief groove 262 is sufficiently larger than a width dimension W4 in the axial direction Da of the second O-ring 1512.

The third relief groove 263 is formed on the inner peripheral surface of the casing 2 in order to avoid contact with the third O-ring 1521 when assembled. As illustrated in FIGS. 1 and 3, the third relief groove 263 is formed at a position shifted to one side Da1 in the axial direction Da with respect to the third O-ring 1521 fixed to the bundle 10 in a state where the bundle 10 is fixed to the casing 2. The third relief groove 263 is formed at a position overlapping the discharge side head 142 in the axial direction Da. The third relief groove 263 has a third upper half relief groove (upper half relief groove) 2631 formed in the upper half casing 21 and a third lower half relief groove (lower half relief groove) 2632 formed in the lower half casing 22. The third upper half relief groove 2631 is recessed outward in the radial direction Dr from the inner peripheral surface of the upper half casing 21 and extends in the circumferential direction Dc. The third lower half relief groove 2632 is formed at a position the same as that of the third upper half relief groove 2631 in the axial direction Da. The third lower half relief groove 2632 is recessed outward in the radial direction Dr from the inner peripheral surface of the lower half casing 22 and extends in the circumferential direction Dc. As illustrated in FIG. 3, a width dimension W5 in the axial direction Da of the third relief groove 263 is larger than a width dimension W6 in the axial direction where the two pairs of third O-rings 1521 are provided.

As illustrated in FIG. 1, the communication gap sealing portion 16 seals a communication gap C formed between the outer peripheral surface of the diaphragm 13 and the inner peripheral surface of the casing 2. The communication gap C is formed between the outer peripheral surface of the diaphragm 13 and the inner peripheral surface of the casing 2 in a state where the bundle 10 is accommodated inside the casing 2. The communication gap C is an annular space extending in the axial direction Da to cause the suction port 236 and the discharge port 237 to communicate with each other.

The communication gap sealing portion 16 of the present embodiment is an O-ring fixed to the outer peripheral surface of the inlet wall 135. Only one communication gap sealing portion 16 is disposed with respect to the communication gap C. Specifically, the communication gap sealing portion 16 is disposed at a position close to the suction port 236 on the outer peripheral surface of the inlet wall 135 (position closest to one side in the axial direction Da as much as possible). The communication gap sealing portion 16 has an annular shape and is formed over the entire periphery of the upper half diaphragm 131 and lower half diaphragm 132 which are combined with each other.

(Configuration of Restriction Member)

Inside the casing 2, a restriction member 18 is provided on one side Da1 in the axial direction Da with respect to the suction side head 141. Together with the end plate 27, the restriction member 18 restricts a position of the bundle 10 in the axial direction Da with respect to the casing 2. Specifically, the restriction member 18 restricts the movement of the suction side head 141 to one side Da1 in the axial direction Da. The restriction member 18 has a first restriction member 430 and a second restriction member 440. The first restriction member 430 and the second restriction member 440 are accommodated in the first relief groove 261 formed in the casing 2 and a head restriction accommodation groove 420 formed in the suction side head 141.

That is, the first relief groove 261 not only has a role of avoiding contact with the first O-ring 1511 when assembled, but also has a role of accommodating the first restriction member 430 and the second restriction member 440. Therefore, the first relief groove 261 is formed to have a size capable of accommodating a portion of the first restriction member 430 and the second restriction member 440. The first relief groove 261 is recessed in a rectangular cross-sectional shape from the inner peripheral surface of the casing 2. The first relief groove 261 is configured to include a restriction accommodation recess portion bottom surface 411 facing inward in the radial direction Dr, a restriction accommodation recess portion first surface 412 facing the other side Da2 in the axial direction Da, and a restriction accommodation recess portion second surface 413 facing one side Da1 in the axial direction Da. The restriction accommodation recess portion bottom surface 411 is a surface parallel to the inner peripheral surface of the casing 2. The restriction accommodation recess portion first surface 412 is a plane connecting the inner peripheral surface of the casing 2 and an outer short side in the axial direction Da of the restriction accommodation recess portion bottom surface 411. The restriction accommodation recess portion second surface 413 is a plane connecting the inner peripheral surface of the casing 2 and an inner short side in the axial direction Da of the restriction accommodation recess portion bottom surface 411.

The head restriction accommodation groove 420 is formed in a corner portion formed between the outer peripheral surface and the suction side head exterior surface 241 (surface facing one side Da1 in the axial direction Da) in the suction side head 141. The head restriction accommodation groove 420 is formed on one side Da1 in the axial direction Da from the first head seal attachment groove 251. The head restriction accommodation groove 420 is configured to include a restriction accommodation groove first surface 421 facing outward in the radial direction Dr and a restriction accommodation groove second surface 422 facing outward in the axial direction Da. The restriction accommodation groove first surface 421 is a surface parallel to the outer peripheral surface of the suction side head 141, and is connected to the suction side head exterior surface 241. The restriction accommodation groove second surface 422 is a plane parallel to the suction side head exterior surface 241, and is a surface connecting the outer peripheral surface of the suction side head 141 and the restriction accommodation groove first surface 421.

The first restriction member 430 is accommodated in the first relief groove 261 together with the second restriction member 440, and is a member that restricts a position of the suction side head 141 in the axial direction Da with respect to the casing 2. The first restriction member 430 has an L-shaped cross section. Specifically, in the first restriction member 430, a first accommodation portion 431 accommodated in the first relief groove 261 and a second accommodation portion 432 accommodated in the head restriction accommodation groove 420 are integrally formed.

The first accommodation portion 431 has a rectangular shape. The second accommodation portion 432 is formed in a rectangular shape to protrude toward the other side Da2 in the axial direction Da from the first accommodation portion 431.

The second restriction member 440 is accommodated in the first relief groove 261 in a state of being adjacent to the first restriction member 430 on one side Da1 in the axial direction Da1 from the first restriction member 430. The second restriction member 440 has a rectangular shape.

When the first restriction member 430 and the second restriction member 440 are attached, the first restriction member 430 is moved to the other side Da2 in the axial direction Da in a state where the first accommodation portion 431 is inserted into the first relief groove 261, and the second accommodation portion 432 is inserted into the head restriction accommodation groove 420. Thereafter, the second restriction member 440 is press-fitted into the first relief groove 261 on one side Da1 in the axial direction Da with respect to the first restriction member 430. As a result, the first restriction member 430 and the second restriction member 440 are in a state of being in contact with each other in a state where both are accommodated in the first relief groove 261 and the head restriction accommodation groove 420. In this case, the second accommodation portion 432 is in contact with the restriction accommodation groove second surface 422, and the second restriction member 440 comes into contact with the restriction accommodation recess portion first surface 412. In this manner, the first restriction member 430 and the second restriction member 440 are in a non-removable state by being pinched between the restriction accommodation recess portion first surface 412 and the restriction accommodation groove second surface 422.

(Procedure of Method for Manufacturing Compressor)

Figure 4:
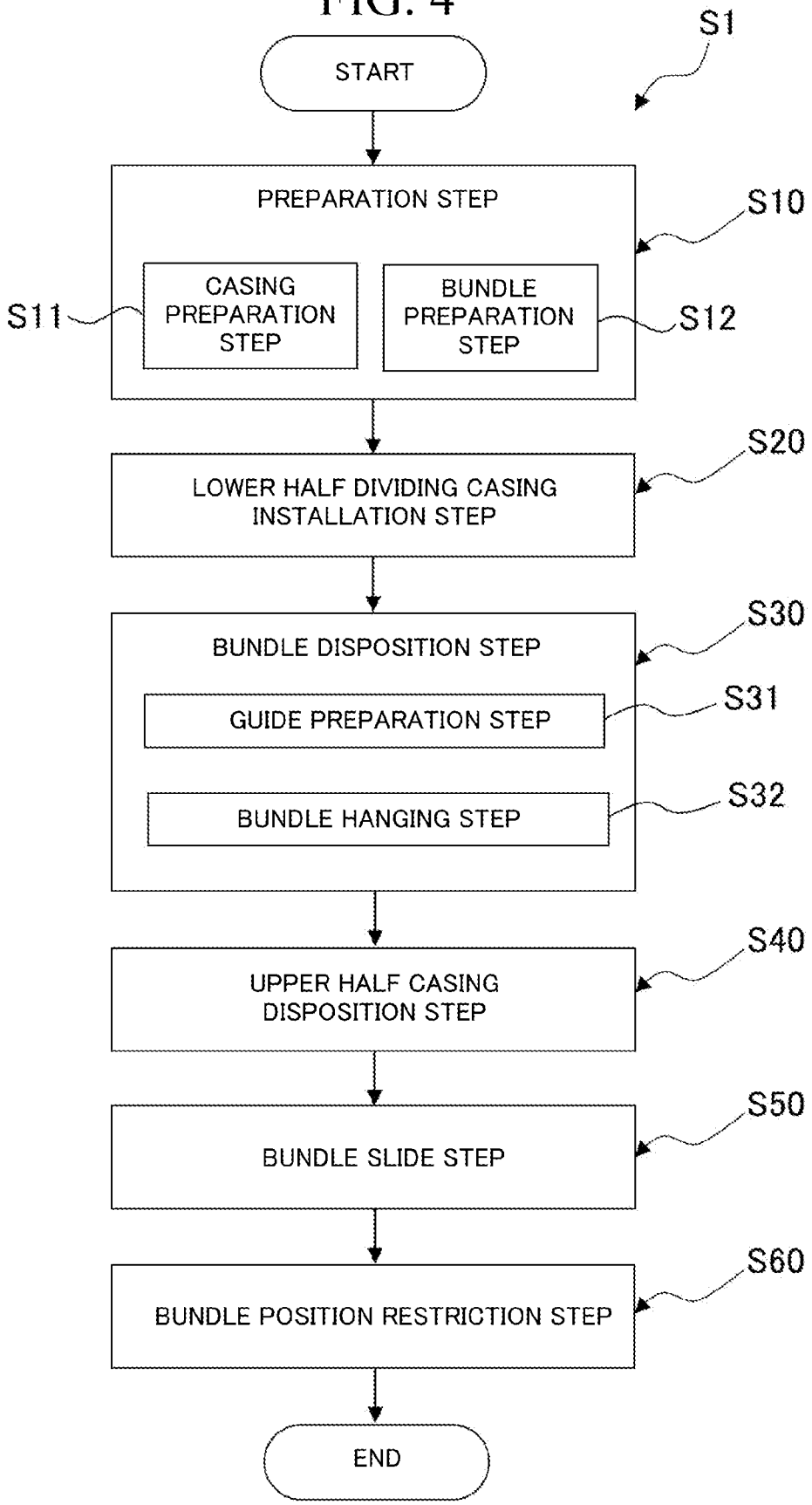
FIG. 4 is a flow chart illustrating a flow of a method for manufacturing a compressor.

Next, a compressor manufacturing method S1 according to the present embodiment will be described. As illustrated in FIG. 4, the compressor manufacturing method S1 of the present embodiment includes a preparation step S10, a lower half casing installation step S20, a bundle disposition step S30, an upper half casing disposition step S40, a bundle slide step S50, and a bundle position restriction step S60.

(Procedure of Preparation Step)

In the preparation step S10, components needed to assemble the compressor 1 are prepared. In the preparation step S10 of the first embodiment, the casing preparation step S11 and the bundle preparation step S12 are simultaneously performed.

In the casing preparation step S11, the upper half casing 21 and the lower half casing 22 which have the first relief groove 261, the second relief groove 262, and the third relief groove 263 are prepared.

In addition, in the bundle preparation step S12, the bundle 10 including the rotor 11, the bearing portion 12, the upper half diaphragm 131, the lower half diaphragm 132, the suction side head 141, the discharge side head 142, the sealing portion 15, and the communication gap sealing portion is prepared. In the bundle preparation step S12, the diaphragm 13 is formed in an annular shape by causing fixing means such as a bolt to fix the upper half diaphragm 131 onto the lower half diaphragm 132 in a state where the rotor 11 is internally disposed. Thereafter, the outer peripheral surfaces of the diaphragms 13 disposed adjacent to each other are welded to form the welding portion 231. In this manner, the plurality of diaphragms 13 are integrated. The communication gap sealing portion 16 is attached to the outer peripheral surface of the integrated diaphragm 13. The first O-ring 1511, the second O-ring 1512, and the third O-ring 1521 which form the sealing portion 15 are attached to the suction side head 141 and the discharge side head 142. In addition, the bearing portion 12 is fixed to the suction side head 141 and the discharge side head 142. Thereafter, the suction side head 141 is fixed to the diaphragm 13 by the bolt member 170. In addition, the discharge side head 142 is fixed to the diaphragm 13 by the bolt member 171. In this manner, the bundle 10 integrated as one component is prepared.

(Procedure of Lower Half Casing Installation Step)

In the lower half casing installation step S20, the lower half casing 22 is installed at a predetermined position on a floor surface.

(Procedure of Bundle Installation Step)

The bundle disposition step S30 is performed after the lower half casing installation step S20. The bundle disposition step S30 includes a guide preparation step S31 and a bundle hanging step S32.

Figure 5:
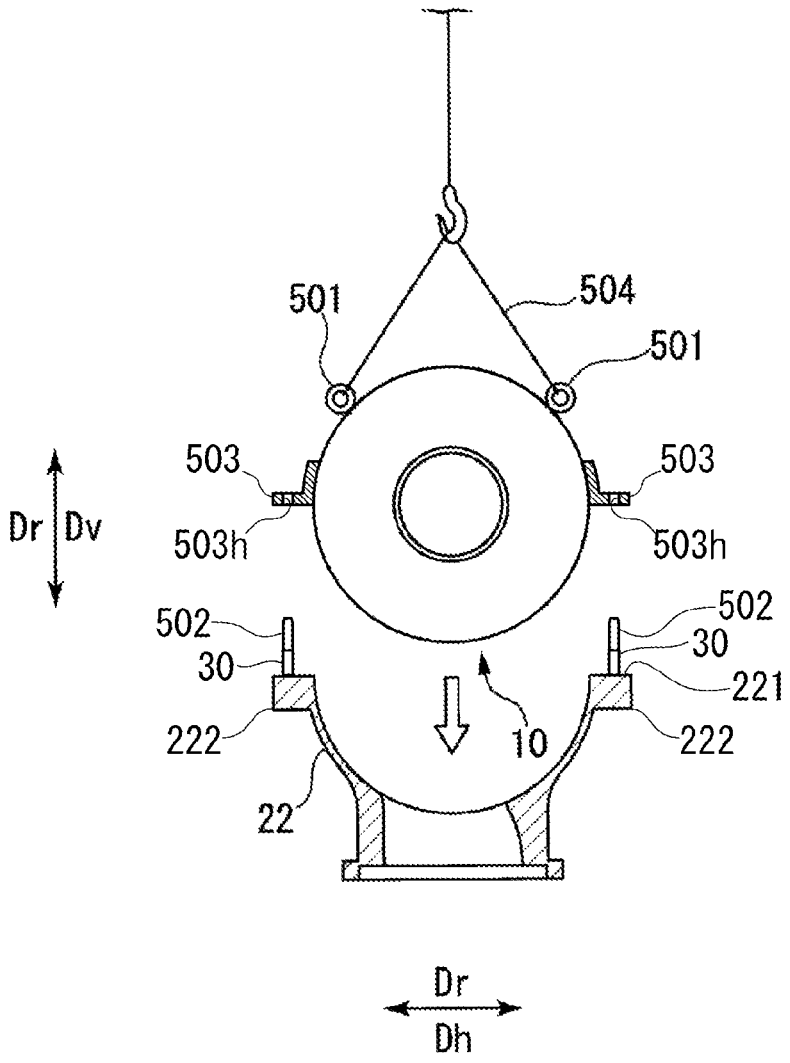
FIG. 5 is a sectional view illustrating a state where a bundle of the compressor is disposed inside a lower half casing.
Figure 6:
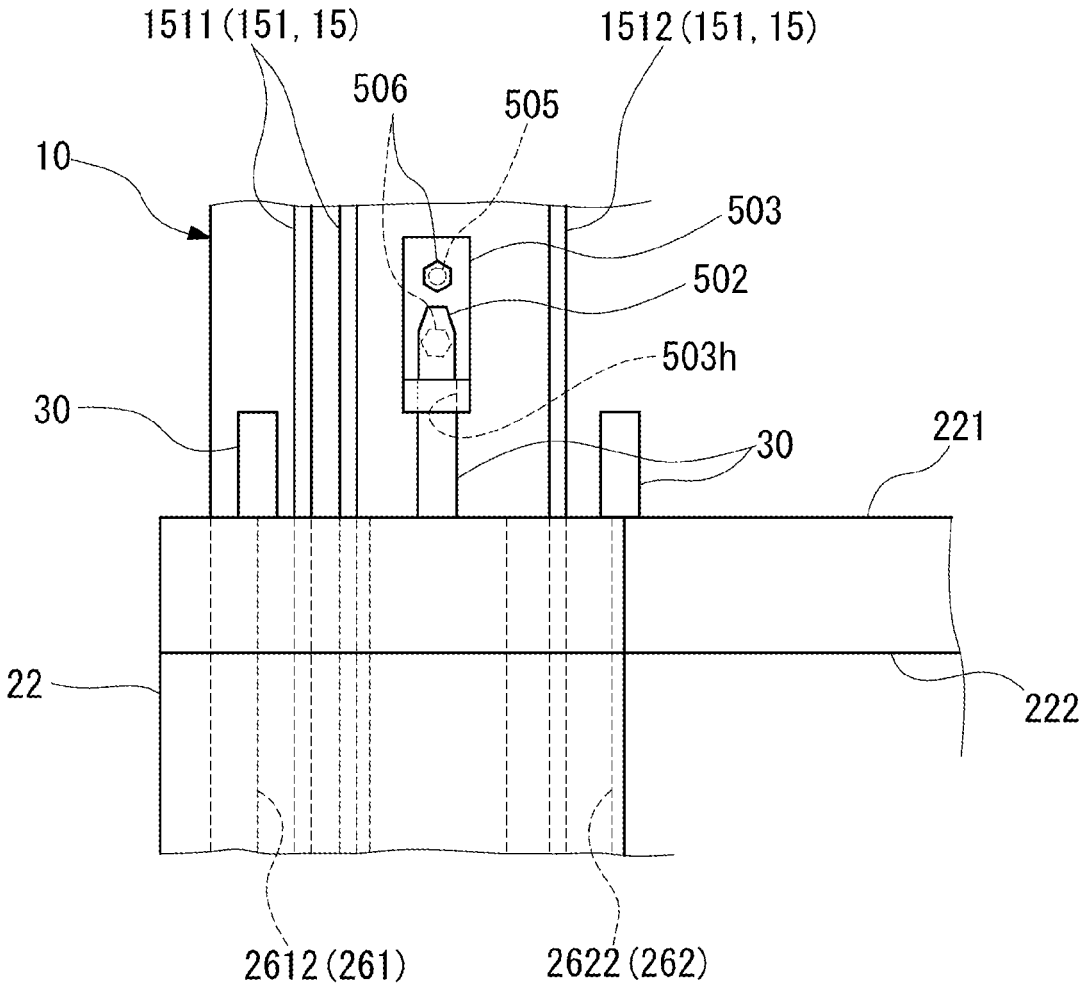
FIG. 6 is a side view illustrating a guide rod attached to the lower half casing of the compressor and a guide member attached to the bundle.

As illustrated in FIGS. 5 and 6, in the guide preparation step S31, a rod-shaped guide rod 502 is attached to the lower half casing 22. Specifically, the guide rod 502 is fixed to a plurality of turbine casing bolts 30 fixed to protrude upward in the vertical direction Dv from the lower half casing dividing surface 221. The guide rod 502 is attached to some of the turbine casing bolts 30 serving as the guide rod attachment portions without being attached to all of the plurality of turbine casing bolts 30. In addition, in the guide preparation step S31, a guide member 503 having an insertion hole 503*h* into which the guide rod 502 is inserted is attached to the bundle 10. The guide member 503 is attached to a guide member attachment portion 505 which is a screw hole formed on the outer peripheral surface of the bundle 10 by an attachment bolt 506. The guide rod 502 is inserted into the insertion hole 503*h* of the guide member 503, thereby determining a position of the bundle 10 with respect to the lower half casing 22 in the axial direction Da and the horizontal direction Dh.

In the present embodiment, the guide rod 502 and the insertion hole 503*h* of the guide member 503 are disposed so that each position of the first O-ring 1511, the second O-ring 1512, and the third O-ring 1521 in the axial direction Da and horizontal direction Dh coincides with each position of the first lower half relief groove 2612, the second lower half relief groove 2622, and the third lower half relief groove 2632 in the axial directions Da.

In the bundle hanging step S32, the bundle 10 is disposed from above in the vertical direction Dv with respect to the lower half casing 22. An eyebolt 501 is fixed in advance to the outer peripheral surface of the bundle 10. In the present embodiment, the eyebolts 501 are respectively attached to two locations of the outer peripheral surface of the suction side head 141 and to two locations of the outer peripheral surface of the discharge side head 142. The eyebolt 501 is attached at a position which is different 45 degrees in the circumferential direction Dc from an upper end in the vertical direction Dv.

In the bundle hanging step S32, a wire 504 is fixed to the eyebolt 501 as illustrated in FIG. 5. The wire 504 is hoisted by using a crane, thereby temporarily lifting the bundle 10 upward in the vertical direction Dv. Thereafter, a horizontal position of the bundle 10 is adjusted so that the guide rod 502 is inserted into the insertion hole 503*h* of the guide member 503, and the bundle 10 is lowered. In this manner, the bundle 10 is lowered along the guide rod 502.

Figure 7:
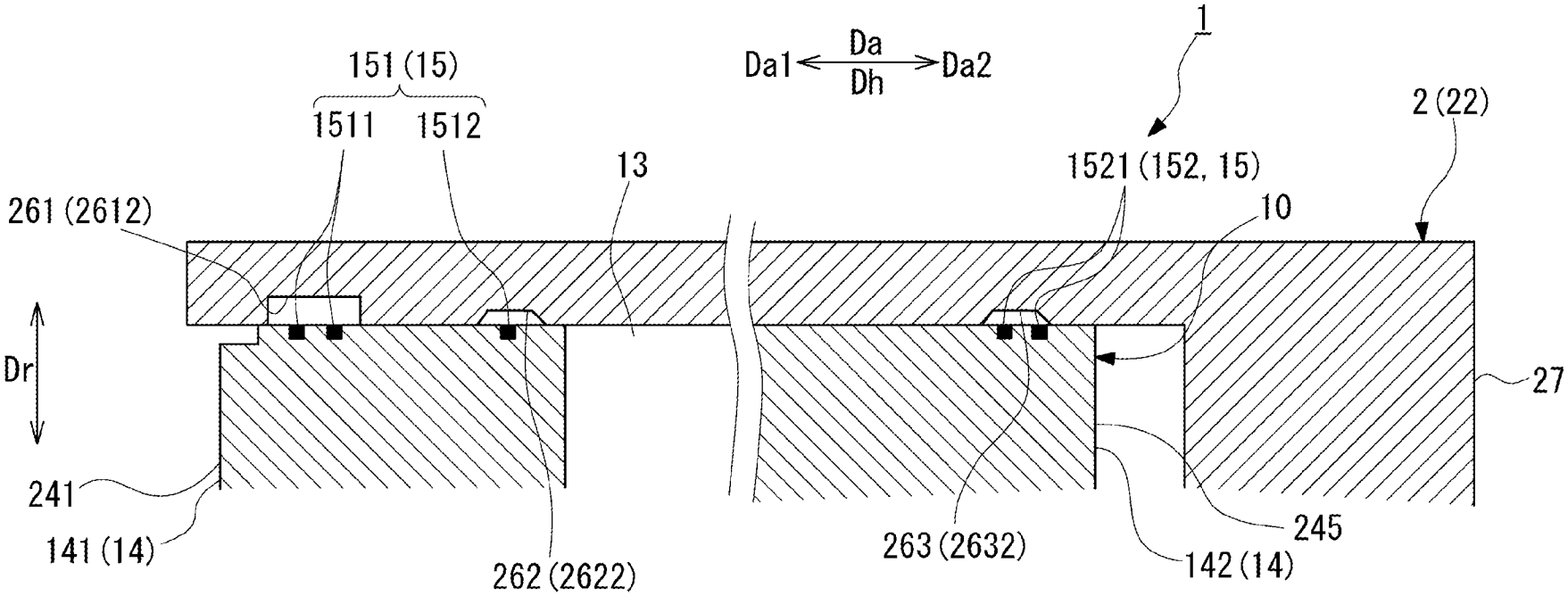
FIG. 7 is a plan sectional view illustrating a state where a position of the O-ring of the bundle in an axial direction is aligned with a position of the relief groove of the casing in the axial direction in the method for manufacturing a compressor.

Thereafter, the bundle 10 is lowered to the inner peripheral side of the lower half casing 22. In this case, when the bundle 10 is disposed inside the lower half casing 22, as illustrated in FIGS. 6 and 7, the bundle 10 is lowered so that the first O-ring 1511, the second O-ring 1512, and the third O-ring 1521 which are provided in the bundle 10 are respectively guided into the first lower half relief groove 2612, the second lower half relief groove 2622, and the third lower half relief groove 2632. When the bundle 10 is disposed inside the lower half casing 22, the attachment bolt 506 is detached from the guide member attachment portion 505, and the guide members 503 are respectively detached from the bundle 10. In addition, in order to prevent foreign matters from entering a screw hole, it is preferable that the screw hole serving as the guide member attachment portion 505 after the attachment bolt 506 is detached is closed by a plug (not illustrated).

(Procedure of Upper Half Casing Disposition Step)

Figure 8:
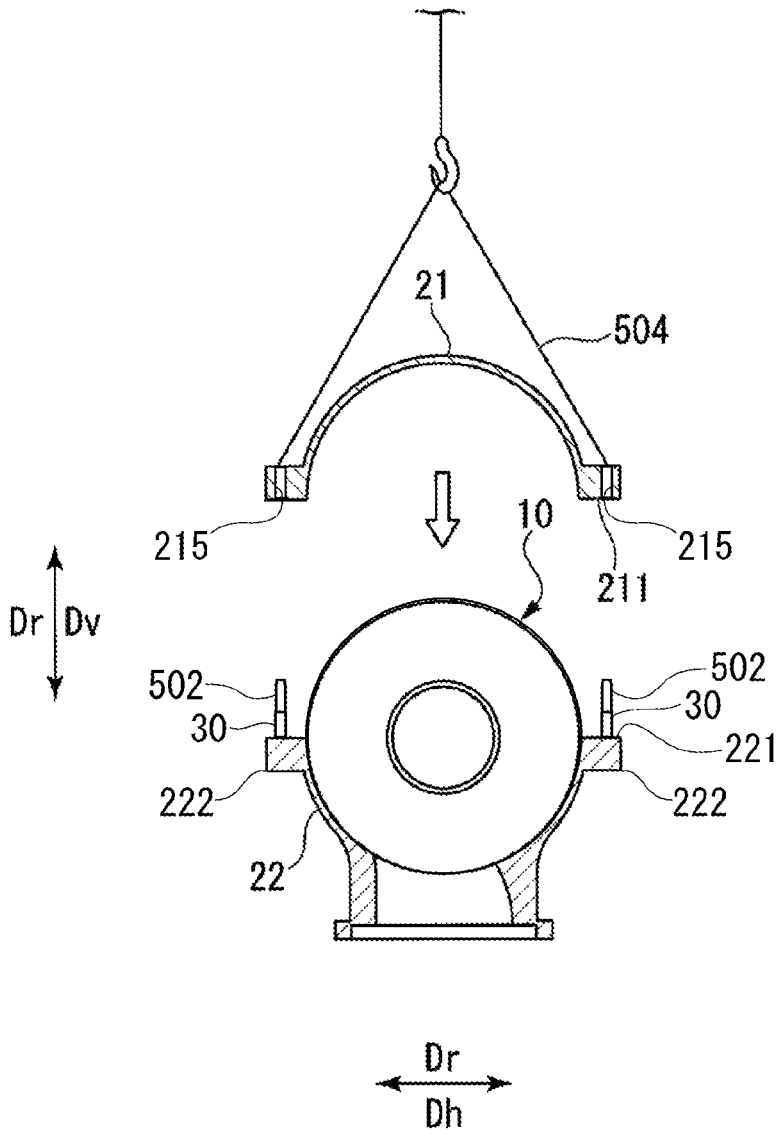
FIG. 8 is a sectional view illustrating a state where an upper half casing of the compressor is disposed on the lower half casing.

The upper half casing disposition step S40 is performed after the bundle disposition step S30. In the upper half casing disposition step S40, as illustrated in FIG. 8, the upper half casing 21 is disposed from above in the vertical direction Dv with respect to the bundle 10 fitted into the lower half casing 22. The wire 504 is fixed to the flange of the upper half casing 21. The wire 504 is hoisted by using a crane, thereby temporarily lifting the upper half casing 21 upward in the vertical direction Dv. Thereafter, the upper half casing 21 is lowered above the bundle 10.

In the upper half casing disposition step S40, when the upper half casing 21 is lowered to the vicinity of the lower half casing 22, the horizontal position is adjusted so that the bundle 10 is accommodated on the inner peripheral side of the upper half casing 21. When the bundle 10 is disposed inside the upper half casing 21, the positioning hole 215 formed in the upper half casing 21 is inserted into the guide rod 502 fixed to the lower half casing 22. In this manner, the positions of the first upper half relief groove 2611, the second upper half relief groove 2621, and the third upper half relief groove 2631 in the axial direction Da coincide with the positions of the first O-ring 1511, the second O-ring 1512, and the third O-ring 1521 in the axial direction Da. In this state, the upper half casing 21 is lowered. In this manner, the first O-ring 1511, the second O-ring 1512, and the third O-ring 1521 are respectively guided into the first upper half relief groove 2611, the second upper half relief groove 2621, and the third upper half relief groove 2631. Thereafter, the upper half casing 21 and the lower half casing 22 are fastened and connected to each other by the turbine casing bolt 30 and the nut 31 in a state where the upper half casing dividing surface 211 is in contact with the lower half casing dividing surface 221. At a completion time of the upper half casing disposition step S40, as illustrated in FIG. 7, the first O-ring 1511, the second O-ring 1512, and the third O-ring 1521 are not in contact with the inner peripheral surface of the lower half casing 22 and the inner peripheral surface of the upper half casing 21. In addition, at the completion time of the upper half casing disposition step S40, the bundle 10 is accommodated inside the casing 2 in a state where the discharge side head surface 245 which is an end surface on the other side Da2 in the axial direction Da of the bundle 10 has an interval from the end plate 27 in the axial direction Da.

(Procedure of Bundle Slide Step)

The bundle slide step S50 is performed after the upper half casing disposition step S40. In the bundle slide step S50, the bundle 10 is pressed against the other side Da2 from one side Da1 in the axial direction Da. For example, when the bundle 10 is pressed, a bundle puller (not illustrated) mounted on the end portion 2*a* on one side Da1 in the axial direction Da of the casing 2 can be used. When the bundle 10 is pressed against the other side Da2 in the axial direction Da by the bundle puller (not illustrated), as illustrated in FIG. 3, the first O-ring 1511, the second O-ring 1512, and the third O-ring 1521 move outward of the first relief groove 261, the second relief groove 262, and the third relief groove 263 from the inside of the first relief groove 261, the second relief groove 262, and the third relief groove 263. In this manner, the first O-ring 1511, the second O-ring 1512, and the third O-ring 1521 come into contact with the inner peripheral surfaces of the lower half casing 22 and the upper half casing 21. As a result, a portion between the outer peripheral surface of the head 14 and the inner peripheral surface of the casing 2 is sealed. The bundle 10 is pressed against the other side Da2 in the axial direction Da until the discharge side head surface 245 abuts against the end plate 27. The discharge side head surface 245 and the end plate 27 come into contact with each other. In this manner, the first relief groove 261 formed in the casing 2 is located at a position which does not overlap the bundle 10 in the axial direction Da, and is brought into an exposed state.

(Procedure of Bundle Position Restriction Step)

The bundle position restriction step S60 is performed after the bundle slide step S50. In the bundle position restriction step S60, the annular restriction member 18 is fitted into the first relief groove 261. Specifically, the first restriction member 430 is moved to the other side Da2 in the axial direction Da in a state where the first accommodation portion 431 is inserted into the first relief groove 261, and the second accommodation portion 432 is inserted into the head restriction accommodation groove 420. Thereafter, the second restriction member 440 is press-fitted into the first relief groove 261 on one side Da1 in the axial direction Da with respect to the first restriction member 430. In this manner, the first restriction member 430 and the second restriction member 440 restrict the movement of the bundle 10 to one side Da1 in the axial direction Da. In this way, the compressor 1 is completely assembled.

(Operational Effect)

According to the compressor manufacturing method S1 and the compressor 1 as described above, when the bundle 10 is installed inside the lower half casing 22, the positions of the first O-ring 1511, the second O-ring 1512, and the third O-ring 1521 in the axial direction Da coincide with the positions of the first lower half relief groove 2612, the second lower half relief groove 2622, and the third lower half relief groove 2632 in the axial direction Da. In this manner, the first O-ring 1511, the second O-ring 1512, and the third O-ring 1521 do not come into contact with the lower half casing 22. Therefore, when the bundle 10 is accommodated in the lower half casing 22, it is possible to reduce the possibility that the first O-ring 1511, the second O-ring 1512, and the third O-ring 1521 may be damaged by coming into contact with the lower half casing dividing surface 221 and the inner peripheral surface of the lower half casing 22.

In addition, when the bundle 10 is installed inside the lower half casing 22, the bundle 10 may be fitted into the lower half casing 22 so that the first O-ring 1511, the second O-ring 1511, and the third O-ring 1521 enter the first lower half relief groove 2612, the second lower half relief groove 2622, and the third lower half relief groove 2632. That is, it is not necessary to accurately align the bundle 10 and the lower half casing 22 with each other in the axial direction Da. In particular, the width dimensions of the first lower half relief groove 2612, the second lower half relief groove 2622, and the third lower half relief groove 2632 in the axial direction are larger than the width of the first O-ring 1511, the second O-ring 1512, and the third O-ring 1521 in the axial direction Da. Accordingly, the bundle 10 can be fitted into the lower half casing 22 with enough margin.

Furthermore, when the upper half casing 21 is installed on the lower half casing 22, the positions of the first upper half relief groove 2611, the second upper half relief groove 2621, and the third upper half relief groove 2631 in the axial direction Da coincide with the positions of the first O-ring 1511, the second O-ring 1512, and the third O-ring 1521 in the axial direction Da. In this manner, the first O-ring 1511, the second O-ring 1512, and the third O-ring 1521 do not come into contact with the upper half casing 21. Therefore, when the upper half casing 21 is installed, it is possible to reduce the possibility that the first O-ring 1511, the second O-ring 1512, and the third O-ring 1521 may be damaged by coming into contact with the upper half casing dividing surface 211 and the inner peripheral surface of the upper half casing 21.

In addition, when the upper half casing 21 is installed on the lower half casing 22, the bundle 10 may be covered with the upper half casing 21 so that the first O-ring 1511, the second O-ring 1512, and the third O-ring 1521 enter the first upper half relief groove 2611, the second upper half relief groove 2621, and the third upper half relief groove 2631. That is, it is not necessary to accurately align the upper half casing 21 and the bundle 10 with each other in the axial direction Da. In particular, the width dimensions of the first upper half relief groove 2611, the second upper half relief groove 2621, and the third upper half relief groove 2631 in the axial direction are larger than the width of the first O-ring 1511, the second O-ring 1512, and the third O-ring 1521 in the axial direction Da. Accordingly, the upper half casing 21 can be fitted into the bundle 10 with enough margin.

Thereafter, the bundle 10 is pressed against the other side Da2 from one side Da1 in the axial direction Da, and the first O-ring 1511, the second O-ring 1512, and the third O-ring 1521 are brought into contact with the inner peripheral surface of the lower half casing 22 and the inner peripheral surface of the upper half casing 21. In this manner, it is possible to ensure sealing performance of a gap between the outer peripheral surface of the head 14 forming the bundle 10 and the inner peripheral surface of the casing 2.

In this manner, it is possible to efficiently assemble the compressor 1 sealed between the outer peripheral surface of the bundle 10 and the inner peripheral surface of the casing 2 while preventing damage to the O-ring.

In addition, the restriction member 18 that restricts the movement of the bundle 10 to one side Da1 in the axial direction Da is fitted into the first lower half relief groove 2612 and the first upper half relief groove 2611. Therefore, the first restriction member 430 and the second restriction member 440 can be attached from the outside of the compressor 1 after the upper half casing 21 is installed on the bundle 10. Therefore, when the bundle 10 is installed in the lower half casing 22 or when the upper half casing 21 is installed on the bundle 10, it is no longer necessary to finely adjust the positions of the bundle 10, the lower half casing 22, and the upper half casing 21 in the axial direction Da. In this manner, assembly efficiency can be further improved.

Furthermore, the first lower half relief groove 2612 and the first upper half relief groove 2611 compatibly have a function of preventing the first O-ring 1511 from coming into contact with the inner peripheral surface of the casing 2 and a function of fitting the restriction member 18. Therefore, it is possible to reduce the number of processing locations on the inner peripheral surface of the casing 2.

In addition, the position of the lower half casing 22 in the axial direction Da and the position of the bundle 10 in the axial direction Da can be easily aligned with each other by the guide rod 502 fixed to the lower half casing 22 and the guide member 503 fixed to the bundle 10. Furthermore, the guide rod 502 is used so that the position of the lower half casing 22 in the axial direction Da and the position of the upper half casing 21 in the axial direction Da can be easily aligned with each other by the positioning hole 215 formed in the upper half casing 21. In this manner, the compressor 1 can be more efficiently assembled.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

For example, the compressor manufacturing method S1 may include a step of detaching the bundle 10 to perform adjustment, maintenance, and disassembly when assembled. Specifically, in the step of detaching the bundle 10, after unfastening the turbine casing bolt 30 and the nut (not illustrated), the upper half casing 21 is lifted upward and detached from the lower half casing 22 and the bundle 10. Thereafter, the bundle 10 is detached from the lower half casing 22. The step of detaching the bundle 10 has a step of attaching the reaction force receiving member 601 to the bundle 10 and a step of pushing the reaction force receiving member 601 upward in the vertical direction Dv.

Figure 9:
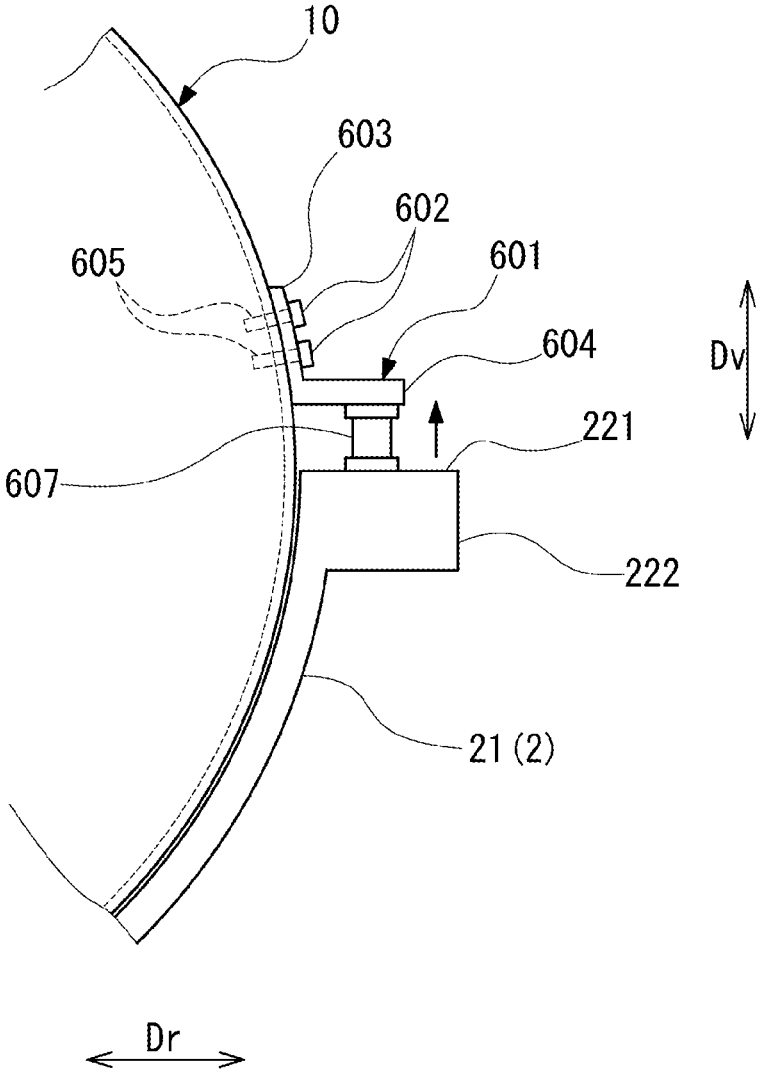
FIG. 9 is a sectional view illustrating a state where a reaction force receiving member provided in the bundle of the compressor is used so that the bundle is lifted by a jack.

In the step of attaching the reaction force receiving member 601 to the bundle 10, as illustrated in FIG. 9, the reaction force receiving member 601 is attached to the bundle 10 to protrude from the outer surface of the bundle 10. Specifically, the reaction force receiving member 601 is mounted by a fixing bolt 602 at a position spaced apart from the lower half casing 22 in the vertical direction Dv. Therefore, a screw hole is formed on the outer peripheral surface of the bundle 10 as a reaction force receiving member attachment portion 605 on which the reaction force receiving member 601 is mounted to be attachable and detachable. The reaction force receiving member 601 integrally includes a base portion 603 along the outer peripheral surface of the bundle 10 and a receiving portion 604 protruding in the radial direction Dr from the base portion 603 along a horizontal plane. In the present embodiment, the reaction force receiving member 601 is disposed so that the receiving portion 604 is parallel to the flange 222 of the lower half casing 22 at an interval in the vertical direction Dv.

In the step of pushing the reaction force receiving member 601 upward in the vertical direction Dv, the reaction force receiving member 601 is pushed upward with respect to the lower half casing 22 by the jack 607. Specifically, first, a jack 607 driven to stretch and shrink in the vertical direction Dv by hydraulic pressure is interposed between the receiving portion 604 and the flange 222. The jack 607 stretches along the vertical direction Dv to press the receiving portion 604 upward. In this manner, the bundle 10 together with the receiving portion 604 is pushed upward in the vertical direction Dv with respect to the lower half casing 22. In this manner, the bundle 10 is detached from the lower half casing 22.

The steps are performed in this way. Accordingly, the bundle 10 can be lifted upward with a strong force in the vertical direction Dv with respect to the lower half casing 22 by the jack 607 disposed between the reaction force receiving member 601 fixed to the bundle 10 and the lower half casing 22. When the bundle 10 is detached by being lifted upward from the lower half casing 22, in some cases, the outer peripheral surface of the bundle 10 and the inner peripheral surface of the lower half casing 22 may be fixed to each other due to a component contained in a fluid. However, even when the outer peripheral surface of the bundle 10 and the inner peripheral surface of the lower half casing 22 are brought into close contact with (fixed to) each other, the bundle 10 can be reliably detached from the lower half casing 22 by the jack 607.

As illustrated in FIG. 9, the position for disposing the reaction force receiving member 601 is not limited to the outer peripheral surface of the bundle 10. The reaction force receiving member 601 can be provided above other appropriate positions of the lower half casing 22 as long as the bundle 10 can be pushed upward with respect to the lower half casing 22. Therefore, for example, the reaction force receiving member 601 may be attached to an end surface of the bundle 10 in the axial direction Da.

In addition, for example, the adjacent diaphragms 13 may be fixed to each other by using another fixing means without being limited to the welding. In addition, in the present embodiment, four diaphragms 13 are provided. However, the number of the diaphragms 13 is not limited thereto, and design can be appropriately changed depending on the number of stages of the impellers 112.

In addition, in the above-described respective embodiments, the uniaxial multi-stage centrifugal compressor has been described as an example of the compressor. However, the compressor of the present invention is not limited thereto. For example, the compressor may be an axial flow compressor.

In addition, a configuration of the bundle is not limited to the configuration of the present embodiment. The bundle may include another configuration element excluding the casing out of the configuration elements of the compressor, and may not include some of the configuration elements of the present embodiment.

In addition, in the present embodiment, the sealing portion 15 has been described as an example of the O-ring disposed on the outer peripheral surface of the bundle 10 which corresponds to the relief groove. However, the O-ring disposed on the outer peripheral surface of the bundle 10 may be an O-ring disposed in other portions. That is, a configuration is not limited to the O-ring disposed on the outer peripheral surface of the head 14, and the O-ring may be disposed on the outer peripheral surface of the diaphragm 13. Therefore, the O-ring corresponding to the relief groove may be the communication gap sealing portion 16.

In addition, the number of the O-rings in the first sealing portion 151 or the second sealing portion 152 is not limited to the number of the O-rings according to the present embodiment. Furthermore, when the plurality of O-rings are provided, materials of the plurality of O-rings may be entirely the same as each other, or may be partially or entirely different from each other.

Appendix

The manufacturing method S1 for the compressor 1 and the compressor 1 according to the embodiment can be understood as follows, for example.

(1) According to a first aspect, the manufacturing method S1 for the compressor 1 includes the step S11 of preparing the casing 2 that includes the lower half casing 22 having the lower half relief grooves 2612, 2622, and 2632 recessed from the inner peripheral surface and extending in the circumferential direction Dc and the upper half casing 21 having the upper half relief grooves 2611, 2621, and 2631 recessed from the inner peripheral surface and extending in the circumferential direction Dc, and has the cylindrical shape having the open end portion and formed around the axis O, the step S12 of preparing the bundle 10 that has the columnar shape, includes the impeller 112 and the plurality of diaphragms 13, configured to be disposed inside the casing 2, and includes the O-rings 1511, 1512, and 1521 disposed on the outer peripheral surface, the step S20 of installing the lower half casing 22, the step S30 of installing the bundle 10 inside the lower half casing 22 from above the lower half casing 22 so that the positions of the O-rings 1511, 1512, and 1521 in the axial direction Da in which the axis O extends coincide with the position of the lower half relief groove in the axial direction Da, the step S40 of installing the upper half casing 21 on the lower half casing from above the bundle so that the positions of the upper half relief grooves 2611, 2621, and 2631 in the axial direction Da coincide with the positions of the O-rings 1511, 1512, and 1521 in the axial direction Da, and the step of pressing the bundle 10 from the first side Da1 to the second side Da2 in the axial direction Da to move the O-rings 1511, 1512, and 1521 to the positions away from the lower half relief grooves 2612, 2622, and 2632 and the upper half relief grooves 2611, 2621, and 2631, and bringing the O-rings 1511, 1512, and 1521 into contact with the inner peripheral surface of the lower half casing 22 and the inner peripheral surface of the upper half casing 21.

According to the manufacturing method S1 for the compressor 1, when the bundle 10 is installed inside the lower half casing 22, the positions of the O-rings 1511, 1512, and 1521 in the axial direction Da are set to coincide with the positions of the lower half relief grooves 2612, 2622, and 2632 in the axial direction Da. In this manner, the O-rings 1511, 1512, and 1521 do not come into contact with the lower half casing 22. Therefore, when the bundle 10 is accommodated in the lower half casing 22, it is possible to reduce the possibility that the O-rings 1511, 1512, and 1521 may be damaged by coming into contact with the dividing surface and the inner peripheral surface of the lower half casing 22. In addition, when the bundle 10 is installed inside the lower half casing 22, the bundle 10 may be fitted into the lower half casing 22 so that the O-rings 1511, 1512 and 1521 enter the lower half relief grooves 2612, 2622 and 2632. That is, it is not necessary to accurately align the bundle 10 and the lower half casing 22 with each other in the axial direction Da. Furthermore, when the upper half casing 21 is installed on the lower half casing 22, the positions of the upper half relief grooves 2611, 2621, and 2631 in the axial direction Da coincide with the positions of the O-rings 1511, 1512, and 1521 in the axial direction Da. In this manner, the O-rings 1511, 1512, and 1521 do not come into contact with the upper half casing 21. Therefore, when the upper half casing 21 is installed, it is possible to reduce the possibility that the O-rings 1511, 1512, and 1521 may be damaged by coming into contact with the dividing surface and the inner peripheral surface of the upper half casing 21. In addition, when the upper half casing 21 is installed on the lower half casing 22, the bundle 10 may be covered with the upper half casing 21 so that the O-rings 1511, 1512, and 1521 enter the upper half relief grooves 2611, 2621, and 2631. That is, it is not necessary to accurately align the upper half casing 21 and the bundle 10 with each other in the axial direction Da. In this manner, the compressor 1 can be efficiently assembled while preventing damage to the O-ring.

(2) According to a second aspect, the manufacturing method S1 for the compressor 1 is provided. The manufacturing method S1 for the compressor 1 according to (1) may further include the step S60 of fitting the restriction member 18 capable of coming into contact with the end surface of the bundle 10 in the axial direction Da into the lower half relief grooves 2612, 2622, and 2632 and the upper half relief grooves 2611, 2621, and 2631 in a state where the restriction member 18 is immovable in the axial direction Da, after the O-rings 1511, 1512, and 1521 are brought into contact with the inner peripheral surface of the lower half casing 22 and the inner peripheral surface of the upper half casing 21, and restricting the movement of the bundle 10 to the first side Da1 in the axial direction Da.

In this manner, the restriction member 18 can be attached from the outside of the compressor 1 after the upper half casing 21 is installed on the bundle 10. Therefore, when the bundle 10 is installed in the lower half casing 22 or when the upper half casing 21 is installed on the bundle 10, it is no longer necessary to finely adjust the positions of the bundle 10, the lower half casing 22, and the upper half casing 21 in the axial direction Da. In this manner, assembly efficiency can be further improved. Furthermore, the lower half relief groove 2612 and the upper half relief groove 2611 compatibly have a function of preventing the O-ring 1511 from coming into contact with the inner peripheral surface of the casing 2 and a function of fitting the restriction member 18. Therefore, it is possible to reduce the number of processing locations on the inner peripheral surface of the casing 2.

(3) According to a third aspect, there is provided the manufacturing method S1 for the compressor 1. The manufacturing method S1 for the compressor 1 according to (1) or (2) may further include the step S31 of attaching the guide rod 502 protruding upward in the vertical direction Dv from the lower half casing 22, to the lower half casing 22, and attaching the guide member 503 having the insertion hole 503*h* into which the guide rod 502 is insertable, to the bundle 10. When the bundle 10 is installed inside the lower half casing 22, the guide rod 502 is inserted into the insertion hole 503*h* of the guide member 503 attached to the bundle 10 so that the positions of the O-rings 1511, 1512, and 1521 in the axial direction Da coincide with the positions of the lower half relief grooves 2612, 2622, and 2632 in the axial direction Da.

In this manner, the position of the lower half casing 22 in the axial direction Da and the position of the bundle 10 in the axial direction Da can be easily aligned with each other by the guide rod 502 provided in the lower half casing 22 and the guide member 503 provided in the bundle 10. Therefore, the positions of the O-rings 1511, 1512, and 1521 in the axial direction Da can easily coincide with the positions of the lower half relief grooves 2612, 2622, and 2632 in the axial direction Da, and thus, the compressor 1 can be more efficiently assembled.

(4) According to a fourth aspect, there is provided the manufacturing method S1 for the compressor 1. In the manufacturing method S1 for the compressor 1 according to (3), when the upper half casing 21 is installed on the lower half casing 22 from above the lower half casing 22, the guide rod 502 protruding upward in the vertical direction Dv from the lower half casing 22 may be inserted into the positioning hole 215 formed in the upper half casing 21 so that the positions of the upper half relief grooves 2611, 2621, and 2631 in the axial direction Da coincide with the positions of the O-rings 1511, 1512, and 1521 in the axial direction Da.

In this manner, the guide rod 502 is used so that the position of the lower half casing 22 in the axial direction Da and the position of the upper half casing 21 in the axial direction Da can be easily aligned with each other by the positioning hole 215 formed in the upper half casing 21. In this manner, the compressor 1 can be more efficiently assembled.

(5) According to a fifth aspect, there is provided the manufacturing method S1 for the compressor 1. The manufacturing method S1 for the compressor 1 according to any one of (1) to (3) may further include the step of attaching the reaction force receiving member 601 that receives the reaction force of the jack 607 to the bundle 10 at the position spaced apart from the lower half casing 22 in the vertical direction Dv so that the reaction force receiving member 601 protrudes from the outer surface of the bundle 10, and the step of pushing the reaction force receiving member 601 upward in the vertical direction Dv by the jack 607.

In this manner, the bundle 10 can be lifted upward in the vertical direction Dv with respect to the lower half casing 22 by the jack 607 disposed between the reaction force receiving member 601 mounted on the reaction force receiving member attachment portion 605 of the bundle 10 and the lower half casing 22. In this manner, even when the outer peripheral surface of the bundle 10 and the inner peripheral surface of the lower half casing 22 are fixed to each other, the bundle 10 can be detached upward from the lower half casing 22.

(6) According to a sixth aspect, there is provided the compressor 1 including the casing 2 that includes the lower half casing 22 having the lower half relief grooves 2612, 2622, and 2632 recessed from the inner peripheral surface and extending in the circumferential direction Dc and the upper half casing 21 having the upper half relief grooves 2611, 2621, and 2631 recessed from the inner peripheral surface and extending in the circumferential direction Dc and has the cylindrical shape having the open end portion and formed around the axis O, and the bundle 10 disposed inside the casing 2, that has the columnar shape, that includes the impeller 112 and the plurality of diaphragms 13, and that includes the O-rings 1511, 1512, and 1521 disposed on the outer peripheral surface. The O-rings 1511, 1512, and 1521 may be in contact with the inner peripheral surface of the lower half casing 22 and the inner peripheral surface of the upper half casing 21. The lower half relief grooves 2612, 2622, and 2632 and the upper half relief grooves 2611, 2621, and 2631 may be formed at the positions shifted to the first side Da1 in an axial direction Da in which the axis O extends with respect to the O-rings 1511, 1512, and 1521.

In this manner, after the bundle 10 is installed in the lower half casing 22 by causing the positions of the O-rings 1511, 1512, and 1521 in the axial direction Da to coincide with the positions of the lower half relief grooves 2612, 2622, and 2632 in the axial direction Da, the upper half casing 21 can be installed on the lower half casing 22 by causing the positions of the upper half relief grooves 2611, 2621, and 2631 in the axial direction Da to coincide with the positions of the O-rings 1511, 1512, and 1521 in the axial direction Da. Thereafter, the bundle 10 is pressed against the second side Da2 from the first side Da1 in the axial direction Da, and the O-rings 1511, 1512, and 1521 are moved out of the lower half relief grooves 2612, 2622, and 2632 and the upper half relief grooves 2611, 2621, and 2631 from the inside of the lower half relief grooves 2612, 2622, and 2632 and the upper half relief grooves 2611, 2621, and 2631. In this manner, the O-rings 1511, 1512, and 1521 can be brought into contact with the inner peripheral surface of the lower half casing 22 and the inner peripheral surface of the upper half casing 21. According to the compressor 1 configured in this way, the compressor 1 can be efficiently assembled while ensuring sealing performance of the communication gap between the outer peripheral surface of the diaphragm 13 and the inner peripheral surface of the casing 2.

EXPLANATION OF REFERENCES

1: compressor
2: casing
2*a*: end portion
10: bundle
11: rotor
12: bearing portion
13: diaphragm
14: head
15: sealing portion
16: communication gap sealing portion
18: restriction member
21: upper half casing
22: lower half casing
23: suction port
24: discharge port
27: end plate
27*h*: insertion hole
30: turbine casing bolt (guide rod attachment portion)
31: nut
111: rotor shaft
112: impeller
121: journal bearing
122: thrust bearing
123: bearing cover
131: upper half diaphragm
132: lower half diaphragm
135: inlet wall
136: final stage diaphragm
141: suction side head
142: discharge side head
145: outlet wall portion
146: discharge side head body
151: first sealing portion
152: second sealing portion
170: bolt member
171: bolt member
211: upper half casing dividing surface
212: flange
215: positioning hole
221: lower half casing dividing surface
222: flange
231: welding portion
235: casing flow path
236: suction port
237: discharge port
241: suction side head exterior surface
245: discharge side head surface
251: first head seal attachment groove
252: second head seal attachment groove
253: third head seal attachment groove
261: first relief groove (relief groove)
262: second relief groove (relief groove)
263: third relief groove (relief groove)
411: restriction accommodation recess portion bottom surface
412: restriction accommodation recess portion first surface
413: restriction accommodation recess portion second surface
420: head restriction accommodation groove
421: restriction accommodation groove first surface
422: restriction accommodation groove second surface
430: first restriction member
431: first accommodation portion
432: second accommodation portion
440: second restriction member
501: eyebolt
502: guide rod
503: guide member
503*h*: insertion hole
504: wire
505: guide member attachment portion
506: attachment bolt
601: reaction force receiving member
602: fixing bolt
603: base portion
604: receiving portion
605: reaction force receiving member attachment portion
607: jack
1511: first O-ring (O-ring)
1512: second O-ring (O-ring)
1521: third O-ring (O-ring)
2611: first upper half relief groove (upper half relief groove)
2612: first lower half relief groove (lower half relief groove)
2621: second upper half relief groove (upper half relief groove)
2622: second lower half relief groove (lower half relief groove)
2631: third upper half relief groove (upper half relief groove)
2632: third lower half relief groove (lower half relief groove)
Da: axial direction
Da1: one side (first side)
Da2: other side (second side)
Dc: circumferential direction
Dh: horizontal direction
Dr: radial direction
Dv: vertical direction
L: cross section
O: axis
S1: compressor manufacturing method
S10: preparation step
S11: casing preparation step
S12: bundle preparation step
S20: lower half casing installation step
S30: bundle disposition step
S31: guide preparation step
S32: bundle hanging step
S40: upper half casing disposition step
S50: bundle slide step
S60: bundle position restriction step
W1 to W6: width dimension

What is claimed is:

1. A method for manufacturing a compressor, comprising:

a step of preparing a casing that includes a lower half casing having a lower half relief groove recessed from an inner peripheral surface and extending in a circumferential direction and an upper half casing having an upper half relief groove recessed from an inner peripheral surface and extending in the circumferential direction, and has a cylindrical shape having an open end portion and formed around an axis;

a step of preparing a bundle that has a columnar shape, includes an impeller and a plurality of diaphragms, configured to be disposed inside the casing, and includes an O-ring disposed on an outer peripheral surface;

a step of installing the lower half casing;

a step of installing the bundle inside the lower half casing from above the lower half casing so that a position of the O-ring in an axial direction in which the axis extends coincides with a position of the lower half relief groove in the axial direction;

a step of installing the upper half casing on the lower half casing from above the bundle so that a position of the upper half relief groove in the axial direction coincides with the position of the O-ring in the axial direction;

a step of pressing the bundle from a first side to a second side in the axial direction to move the O-ring to a position away from the lower half relief groove and the upper half relief groove, and bringing the O-ring into contact with the inner peripheral surface of the lower half casing and the inner peripheral surface of the upper half casing; and a step of fitting a restriction member capable of coming into contact with an end surface of the bundle in the axial direction into the lower half relief groove and the upper half relief groove in a state where the restriction member is immovable in the axial direction, after the O-ring is brought into contact with the inner peripheral surface of the lower half casing and the inner peripheral surface of the upper half casing, and restricting a movement of the bundle to the first side in the axial direction.

2. The method for manufacturing a compressor according to claim 1, further comprising:

a step of attaching a guide rod to the lower half casing; and a step of attaching a guide member to the bundle, wherein the guide rod protrudes upward in a vertical direction from the lower half casing, the guide member has an insertion hole into which the guide rod is insertable, and when the bundle is installed inside the lower half casing, the guide rod is inserted into the insertion hole of the guide member attached to the bundle so that the position of the O-ring in the axial direction coincides with the position of the lower half relief groove in the axial direction.

3. The method for manufacturing a compressor according to claim 2, wherein when the upper half casing is installed on the lower half casing from above the lower half casing, the guide rod protruding upward in the vertical direction from the lower half casing is inserted into a positioning hole formed in the upper half casing so that the position of the upper half relief groove in the axial direction coincides with the position of the O-ring in the axial direction.

4. The method for manufacturing a compressor according to claim 1, further comprising;

a step of attaching a reaction force receiving member that receives a reaction force of a jack to the bundle at a position spaced apart from the lower half casing in a vertical direction so that the reaction force receiving member protrudes from an outer surface of the bundle; and a step of pushing the reaction force receiving member upward in the vertical direction by the jack.

* * * * *